US006746206B2

(12) United States Patent
Madsen et al.

(10) Patent No.: US 6,746,206 B2
(45) Date of Patent: Jun. 8, 2004

(54) CENTRIFUGAL PUMP

(75) Inventors: Steffen Madsen, Orsted (DK); Peter Lindberg, Bjerringbro (DK)

(73) Assignee: Grundfos A/S, Bjerringbro (DK)

( * ) Notice: Subject to any disclaimer, the term of this patent is extended or adjusted under 35 U.S.C. 154(b) by 71 days.

(21) Appl. No.: 10/247,092

(22) Filed: Sep. 19, 2002

(65) Prior Publication Data

US 2003/0072650 A1 Apr. 17, 2003

(30) Foreign Application Priority Data

Sep. 20, 2001 (DE) ..... 201 15 516

(51) Int. Cl.[7] ..... F04D 29/28
(52) U.S. Cl. ..... 415/121.1; 415/131; 415/213.1
(58) Field of Search ..... 415/121.1, 131, 415/140, 174.2, 213.1

(56) References Cited

U.S. PATENT DOCUMENTS 3,771,927 A 11/1973 Schiller

FOREIGN PATENT DOCUMENTS

DE 3340858 5/1984

*Primary Examiner*—Edward K. Look
*Assistant Examiner*—Kimya N McCoy
(74) *Attorney, Agent, or Firm*—Jacox, Meckstroth & Jenkins

(57) ABSTRACT

A centrifugal pump wherein a threaded ring is secured in its position by way of a pressure body which presses it against the axial abutment of a pump shaft and which is screwed axially to the end of the pump shaft. The threaded ring is seated loosely on the pump shaft and by a thread which is provided in a front hub region of the pump impeller and into which the thread of the threaded ring is screwed.

5 Claims, 1 Drawing Sheet

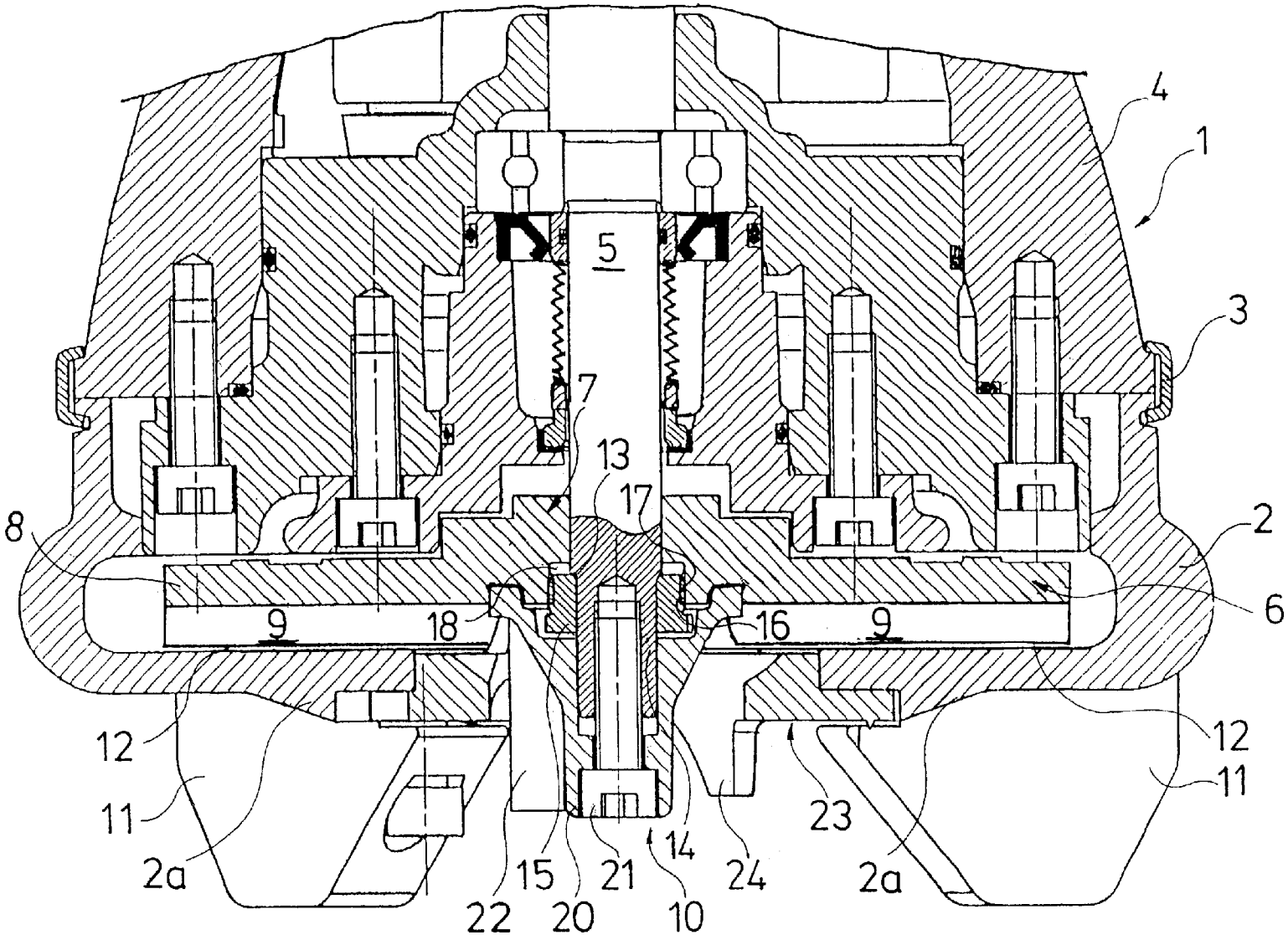
1
2
2a
3
4
5
6
7
8
9
10
11
12
13
14
15
16
17
18
20
21
22
23
24

CENTRIFUGAL PUMP

The invention relates to a centrifugal pump.

A conventional centrifugal pump known in practice includes a distance disk installed therein with which the sealing clearance width between the pump impeller and the front wall region of the pump housing must be reset again after a certain operating time for reasons of wear in order to again increase the efficiency of the pump. This distance disk is seated on the pump shaft and on the one hand bears on its axial abutment and on the other hand on the rear wall of the pump impeller. In this manner, that is, with the help of the thickness of the distance disk, the axial position of the pump impeller on the pump shaft and thus the previously mentioned sealing clearance width is fixed.

If however the sealing clearance width has become too large, and specifically essentially on account of wear at the free axial blade sides of the pump impeller because the impeller has no front cover disk, then a complicated and time-consuming disassembly and reassembly of the impeller is necessary, wherein the pump housing must be opened very wide in order to exchange the mentioned distance disk for a thicker one or in order to place a further distance disk onto the pump shaft. In both cases the increase in thickness of the respective distance disk corresponds to the degree of wear.

SUMMARY OF THE INVENTION

The object of the invention lies in improving a centrifugal pump of the above mentioned type to the extent that the sealing clearance width between the front side of the pump impeller and the wall region of the pump housing, said wall region lying opposite this front side, may be adjusted after appearance of wear on the impeller front side and/or in the suction port region of the pump housing to the original value in a simple and quick manner.

A further object of the invention is the provision of a one-stage centrifugal pump on whose pump shaft, provided in the pump housing there is fastened a pump impeller which on the front side is free of a cover disk, wherein the pump shaft is provided with an axial abutment and a setting means which bears on this and which on the other hand engages on the pump impeller in order to set the sealing clearance width between the blades of the pump impeller and the wall region of the pump housing which lies opposite these blades, wherein the setting means is formed by a threaded ring seated loosely on the pump shaft and by a thread which is provided in the front hub region of the pump impeller and into which the thread of the threaded ring is screwed.

With this solution the mentioned sealing clearance width may again be set quickly and simply to its original width. Only the pressure piece, which in the usual manner with the help of the force of a screw axially screwed into the end of the pump shaft is pressed against the front side of the hub of the pump impeller, needs to be removed by releasing the screw. Thereafter the threaded ring used in place of the previously mentioned distance disk is rotated, whereupon the pump impeller is adjusted to the front, i.e. towards the central suction region. This has the result that the sealing clearance width is reduced again between the blades or the front cover disk of the pump impeller and the wall region, of the pump housing, which lies on the inside opposite these blades or this cover disk. Subsequently the mentioned pressure piece is again placed on and the screw is tightened in order to secure the new setting of the sealing clearance width. With this solution therefore the pump impeller does not need to be disassembled from the pump shaft since the threaded ring to be adjusted is accessible without further ado from the suction region of the pump housing after removal only of the mentioned pressure piece.

The suggested solution is particularly suitable for waste water pumps, and specifically for those which have a central and freely accessible suction region. The solution according to the invention is particularly advantageous with such waste water pumps when cutting means are provided in the central suction region which serves for the size reduction of larger solid matter in the medium being conveyed. Such cutting means apart from a stationary, annular cutting plate comprise a central rotating knife part which is fastened on the pump housing in place of the previously mentioned pressure piece and also assumes the function of the pressure piece. When using the cutting tool the pump impeller is subjected to a high wear on account of the solid matter in the conveyed medium so that the mentioned sealing clearance width increases more quickly. It is therefore necessary to again reset the sealing clearance in shorter time intervals. With this the gain in time with the resetting of the sealing clearance width is advantageously particularly noticeable on account of the solution according to the invention.

In an advantageous embodiment of the centrifugal pump according to the invention the thread of the threaded ring is designed as an outer thread and the thread in the front hub region of the pump impeller as an inner thread. This results in a simple design of the threaded ring. Furthermore it is advantageous for the two threads to be provided as fine threads by which means a very exact setting of the sealing clearance width between the impeller and the pump housing is possible.

Furthermore the threaded ring is secured in its axial position by way of a pressure body, wherein the pressure body presses the threaded ring against the axial abutment of the pump shaft and itself is screwed to the end of the pump shaft. The pressure body may furthermore be designed as a cutting means of a cutting tool provided in the suction region of the centrifugal pump.

Other objects and advantages of the invention will be apparent from the following description, the accompanying drawings and the appended claims.

BRIEF DESCRIPTION OF THE DRAWINGS

The invention is hereinafter explained in more detail by way of an embodiment example shown in the accompanying drawing. The drawing shows the embodiment example in a single FIGURE and in an axial section.

DETAILED DESCRIPTION OF THE INVENTION

The single drawing shows a one-stage centrifugal pump indicated generally at 1, whose housing 2 is fastened on a partly shown drive motor 4 for a centrifugal pump by way of a clamping ring 3. A pump impeller 6 is arranged on the pump shaft 5 in a rotationally secure, but axially displaceable manner. The pump impeller 6 comprises a central hub 7 and a rear cover disk 8 with conventional blades 9. The centrifugal pump 1 is a centrally suctioning pump, which is why the pump housing 2 is provided with a central suction region 10. If the centrifugal pump is advantageously applied as a waste water pump, the pump housing 2 is provided with several support feet 11, with which the centrifugal pump is supported on a support surface (not shown). The pump impeller 6 in the shown case does not have a front cover disk so that its blades 9 lie directly opposite the front wall region 2*a* of the pump housing 2. A sealing clearance 12 exists between the blades 9 and the housing region 2*a*, whose width is set such that the loss in efficiency of the centrifugal pump 1 caused by this clearance is kept as low as possible.

The pump shaft 5 is provided with an axial abutment 13 which in the shown case is formed by a reduced end section 14 of the pump shaft. On this section 14 there is loosely seated a threaded ring 15 which is thus freely rotatable and freely displaceable on the section 14. The threaded ring 15 in the shown case has an outer thread 16 which engages into an inner thread 17 which is provided in a front recess 18 of the hub 7 of the pump impeller 6. Preferably the two threads 16 and 17 are designed as a fine thread so that the pump impeller 6 may adjusted axially in a very exact manner in order again to be able to very exactly set the width of the sealing clearance 12.

On the front end section 14 of the pump shaft 5 there is seated a pressure body 20 which in the shown case by way of a screw 21 engaging axially into the section 14 is pressed against the pump impeller 6. The pressure body 20 thus transmits its pressure force via the pump impeller 6 and via the two mentioned threads 16 and 17 into the threaded ring 15 which for its part presses against the axial abutment 13. Since the pump impeller 6 in the usual manner is seated on the pump shaft 5 in a rotationally secure manner, the pump impeller 6 and the threaded ring 15 are fixed on the pump shaft 5 in a position-secure manner if the pressure body 20 is tightly fastened by way of the screw 21. The pressure body 20 may however also be designed such that it presses against the threaded ring 15 which for its part is then pressed against the axial abutment 12 of the pump shaft and thus is likewise stationarily locked. The pump impeller also in this case may not become maladjusted on account of the rotationally secure mounting of the pump impeller 6 on the pump shaft.

The pressure body 20 may also be designed as a cutting means of a cutting device arranged in the suction region 10 of the centrifugal pump 1, for the size reduction of solid matter parts of the conveyed medium which is delivered by the centrifugal pump and contaminated with solid matter. In this case the pressure body is provided with at least one cutting tooth and serves as a rotating cutting means. The rotating pressure body cooperates with a stationary, annular cutting plate 23 which is arranged on the pump housing 2 in a rotationally secure manner and comprises at least one counter cutting tooth 24.

In an alternative formation of the axial abutment 13 one may proceed in that the pump shaft is provided with a radially projecting ring shoulder whose one axial shoulder serves as an abutment surface for the threaded ring 15. In a further modification the threaded ring 15 is also provided with an inner thread which then engages into a corresponding outer thread of the hub 7 of the pump impeller 6. In this case, the threaded ring 15 is provided with an outer axially running collar which on its inner ring side is provided with the inner thread. The hub 7 for this has an axially projecting ring part which is provided with the outer thread. Furthermore, the pump impeller may also comprise a front cover disk whose run-in edge region with the wall region, of the pump housing, lying opposite this, forms a sealing clearance which after wear must be reset again. The above described threaded ring 15 as the setting ring being discussed here may also be used with multistage centrifugal pumps.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A one-stage centrifugal pump on whose pump shaft provided in the pump housing there is fastened a pump impeller which on the front side is free of a cover disk, wherein the pump shaft is provided with an axial abutment and a setting means which bears on this and which on the other hand engages on the pump impeller in order to set the sealing clearance width between the blades of the pump impeller and the wall region of the pump housing which lies opposite these blades, wherein the setting means is formed by a threaded ring seated loosely on the pump shaft and by a thread which is provided in the front hub region of the pump impeller and into which the thread of the threaded ring is screwed.

2. A centrifugal pump according to claim 1, wherein the thread of the threaded ring is an outer thread and the thread in the front hub region of the pump impeller is an inner thread.

3. A centrifugal pump according to claim 1, wherein the two threads are designed as a fine thread.

4. A centrifugal pump according to claim 1, wherein the threaded ring is secured in its position by way of a pressure body which presses it against the axial abutment of the pump shaft and which is screwed axially to the end of the pump shaft.

5. A centrifugal pump according to claim 4, wherein the pressure body is provided with cutting means for reducing in size solid matter parts of the conveyed medium which is delivered by the centrifugal pump and is contaminated with solid matter.

* * * * *